US006252358B1

(12) United States Patent
Xydis et al.

(10) Patent No.: US 6,252,358 B1
(45) Date of Patent: Jun. 26, 2001

(54) WIRELESS LIGHTING CONTROL

(76) Inventors: Thomas G. Xydis, 1141 Chestnut Rd., Ann Arbor, MI (US) 48104; Paul G. Angott, 442 Five Gaits Ct., Bloomfield, MI (US) 48304

( * ) Notice: Subject to any disclaimer, the term of this patent is extended or adjusted under 35 U.S.C. 154(b) by 0 days.

(21) Appl. No.: 09/134,857

(22) Filed: Aug. 14, 1998

(51) Int. Cl.[7] ..... G05F 1/00

(52) U.S. Cl. ..... 315/295; 315/312; 315/324; 315/149; 359/142; 359/180; 359/189; 362/233

(58) Field of Search ..... 315/295, 291, 315/312, 315, 324, 362, 250, 149, 158, DIG. 4; 359/356, 355, 362, 180, 189, 147, 142, 148; 362/85, 233

(56) References Cited

U.S. PATENT DOCUMENTS

| | | | | |
|---|---|---|---|---|
| 1,987,019 | | 1/1935 | Logan | 240/1 |
| 3,209,136 | | 9/1965 | Fisher | 240/3 |
| 3,287,552 | | 11/1966 | Drandell | 240/41.15 |
| 3,706,914 | | 12/1972 | Van Buren | 315/316 |
| 3,783,263 | | 1/1974 | Cruse | 240/3 |
| 3,845,351 | | 10/1974 | Ballmoos et al. | 315/293 |
| 4,392,187 | | 7/1983 | Bornhorst | 362/233 |
| 4,697,227 | | 9/1987 | Callahan | 362/233 |
| 4,716,344 | | 12/1987 | Newell et al. | 315/312 |
| 4,797,795 | | 1/1989 | Callahan | 362/233 |
| 5,107,184 | | 4/1992 | Hu et al. | 315/291 |
| 5,206,894 | * | 4/1993 | Makrinos et al. | 378/93 |
| 5,209,560 | | 5/1993 | Taylor et al. | 362/85 |
| 5,248,919 | * | 9/1993 | Hanna et al. | 315/291 |
| 5,329,431 | | 7/1994 | Taylor et al. | 362/85 |
| 5,361,019 | | 11/1994 | Angott et al. | 315/324 |
| 5,506,715 | | 4/1996 | Zhu | 359/147 |
| 5,555,120 | * | 9/1996 | Telymonde et al. | 359/147 |
| 5,769,527 | * | 6/1998 | Taylor et al. | 362/85 |
| 5,909,087 | * | 6/1999 | Bryde et al. | 315/149 |

* cited by examiner

*Primary Examiner*—Haissa Philogene
(74) *Attorney, Agent, or Firm*—Howard & Howard

(57) ABSTRACT

An illumination level control assembly (10) includes a plurality of light bulbs (20), and a main power switch (30) for supplying electrical power to the bulbs (20). The assembly (10) includes a remote control (32) with a single button for producing a single signal, and a controller (50) responsive to the remote control (32) for sequentially and in numeric order changing the supply of electrical power to the bulbs (20), whereby successive actuations of the single button changes by one the number of bulbs (20) illuminated. The remote control (32) produces a radio frequency signal, and the controller (50) includes a radio frequency receiver (52) to receive signals from the remote control (32). The controller (50) includes a sequencer (54) for sequentially terminating electrical power to the bulbs (20) to successively terminate electric power to the bulbs (20) one at a time. The sequencer (54) includes a counter (56) for sequencing through predetermined steps, and a series of switches (58) each responsive to one of the steps for terminating electrical power to one of the bulbs (20). The assembly (10) can also include a plurality of fixtures (12,14) with each fixture (12,14) including a plurality of bulbs (20) and a plurality of ballasts (22,24,26,28) with each ballast (22,24,26,28) interconnecting two bulbs (20). Ballasts (22,24,26,28) from different fixtures (12,14) can be electrically connected to be controlled by the controller (50) in unison. In this configuration, each ballast (22,24,26,28) controls one bulb from each fixture (12,14).

16 Claims, 3 Drawing Sheets

WIRELESS LIGHTING CONTROL

BACKGROUND OF THE INVENTION

1) Technical Field

An illumination level control assembly for controlling the level of illumination in a light fixture having a plurality of bulbs connected to an electric power line.

2) Description of the Prior Art

Different work functions require different levels of illumination in an office environment. A desk worker might require a high level of illumination over his work area, while a computer operator might require a lower level of illumination over his computer. Previously, light dimming has required expensive dimming devices to be wired to either office lighting fixtures or lighting panels. A dimming device that is wired to a lighting panel requires an office worker to get up from his desk to operate the dimming device.

A recent attempt at a remote control illumination level device is disclosed in U.S. Pat. No. 5,506,715 to Zhu issued on Apr. 9, 1996. This patent discloses an infrared remote control that signals an infrared receiver to dim, or turn on and off florescent light tubes. The device requires a sophisticated controller to filter infrared noise generated by the light bulbs. An expensive dimming ballast that reduces electric current is also used to dim the bulbs. The expensive electronics required to achieve light dimming with this device is cost prohibitive due to the light filtration that is required and the dimming ballast that must replace a conventional ballast.

SUMMARY OF THE INVENTION AND ADVANTAGES

An illumination level control assembly for controlling the level of illumination in a light fixture having a plurality of bulbs connected to an electric power line. The assembly comprises a remote control with a single button for producing a single signal, and is characterized by a controller responsive to the remote control for sequentially and in numeric order changing the supply of electrical power to the bulbs. Successive actuations of the single button changes by one the number of bulbs illuminated.

The subject invention provides a low cost alternative for dimming the level of illumination from light bulbs without requiring a high cost dimming ballast to regulate electrical current. By utilizing on/off switches as part of the controller, the subject invention eliminates the need for the dimming ballast which also simplifies required rewiring. Additionally, utilizing radio frequency waves rather than infrared waves to signal the controller from a remote control simplifies the controller electronics by eliminating the need for a light wave filter.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
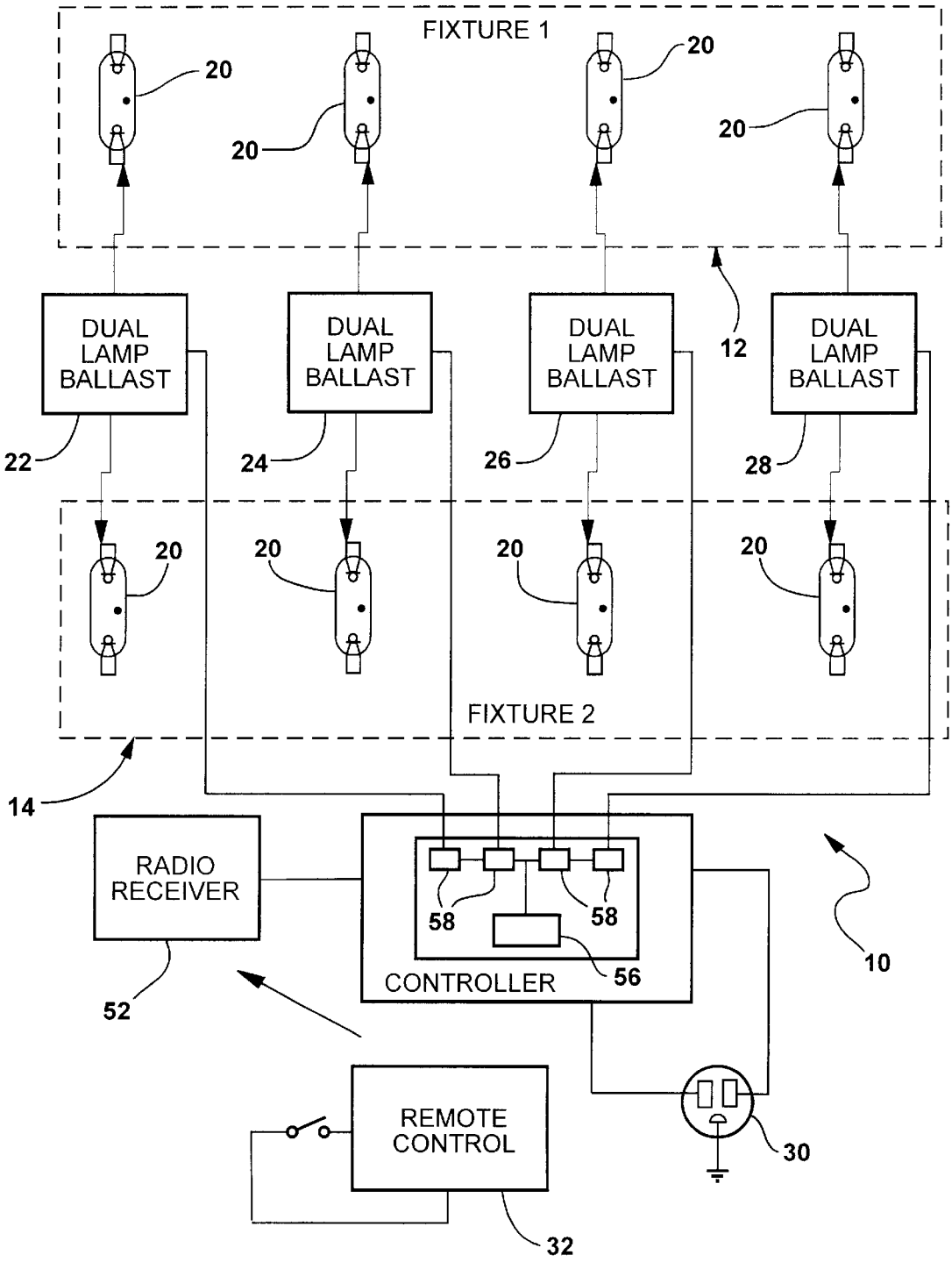
FIG. 1 is a schematic drawing of the embodiment of the subject invention used in conjunction with a dual fixtures having each lamp ballast connected to one bulb from each fixture.

Referring to FIG. 1, wherein like numerals indicate like or corresponding parts throughout the several views, an illumination level control assembly is generally shown at 10, the assembly 10 includes a includes a plurality of fixtures 12,14 generally indicated at 12 and 14, each supporting a plurality of light bulbs 20. A main power switch 30 supplies electrical power to the bulbs 20.

The assembly 10 includes a remote control 32 with a single button for producing a single signal, and a controller 50 responsive to the remote control 32 for sequentially and in numeric order changing the supply of electrical power to the bulbs 20, whereby successive actuations of the single button changes by one the number of bulbs 20 illuminated. The remote control 32 produces a radio frequency signal, and the controller 50 includes a radio frequency receiver 52 to receive signals from the remote control 32.

The controller 50 includes a sequencer 54 for sequentially terminating electrical power to the bulbs 20 to successively terminate electric power to the bulbs 20 one at a time. The sequencer 54 comprises a counter 56 for sequencing through predetermined steps, and a series of switches 58 each responsive to one of the steps for terminating electrical power to one of the bulbs 20. For example, each fixture 12,14 has four bulbs 20 and a sequence starts with electrical power being supplied to all four of the bulbs 20. A single depression of the remote control 32 button will terminate power to one bulb to achieve a 75% lighting level. A second depression of the remote control 32 button will terminate power to a second bulb 20 to achieve a 50% lighting level. A third depression will terminate power to a third bulb 20 to achieve a 25% lighting level. A fourth depression will return the controller 50 to the beginning of the sequence by re-initiating power to all of the bulbs 20.

Some conditions require more than one controller 50 system to be located in close proximity, for example, two fixtures closely adjacent and operated independently. For this condition, the remote control 32 includes code means 33 for producing an encoded message in the single signal. Each receiver 52 will be encoded to receive a radio frequency signal from only one remote control 32. This will allow multiple light levels to be achieved within close proximity to one another, i.e. the adjacent fixtures may be operated independent of one another to allow different levels of luminosity.

Each fixture 12,14 includes a plurality of ballasts 22,24, 26,28 with each ballast 22,24,26,28 interconnecting two bulbs 20. Ballasts 22,24,26,28 from different fixtures 12,14 are electrically connected to be controlled by the controller 50 in unison. In this configuration, each ballast 22,24,26,28 controls one bulb from each fixture 12,14. This enables a uniform light dimming to be achieved throughout an array of fixtures. For example, in the case of two fixtures 12,14 being cross-wired, a first depression of the remote control button terminates electrical power to the first ballast 22 which turns off one bulb in each fixture 12,14 to achieve a 75% lighting level. A second depression of the remote control 32 button terminates power to the second ballast 24 turning off two bulbs 20 in each fixture 12,14 to achieve a uniform 50% lighting level. A third depression of the remote control 32 button terminates power to the third ballast 26 turning off three bulbs 20 in each fixture 12,14 to achieve a uniform 25% lighting level. A fourth depression returns the controller 50 to the beginning of the sequence by initiating power to all of the ballasts 9,10,11,12. Multiple fixtures 12,14 could be cross-wired in this fashion to achieve a uniform lighting level throughout. This connection allows the system to use two-lamp ballasts which are already installed in four-lamp fixtures, thus lowering the cost of retrofit.

Figure 3:
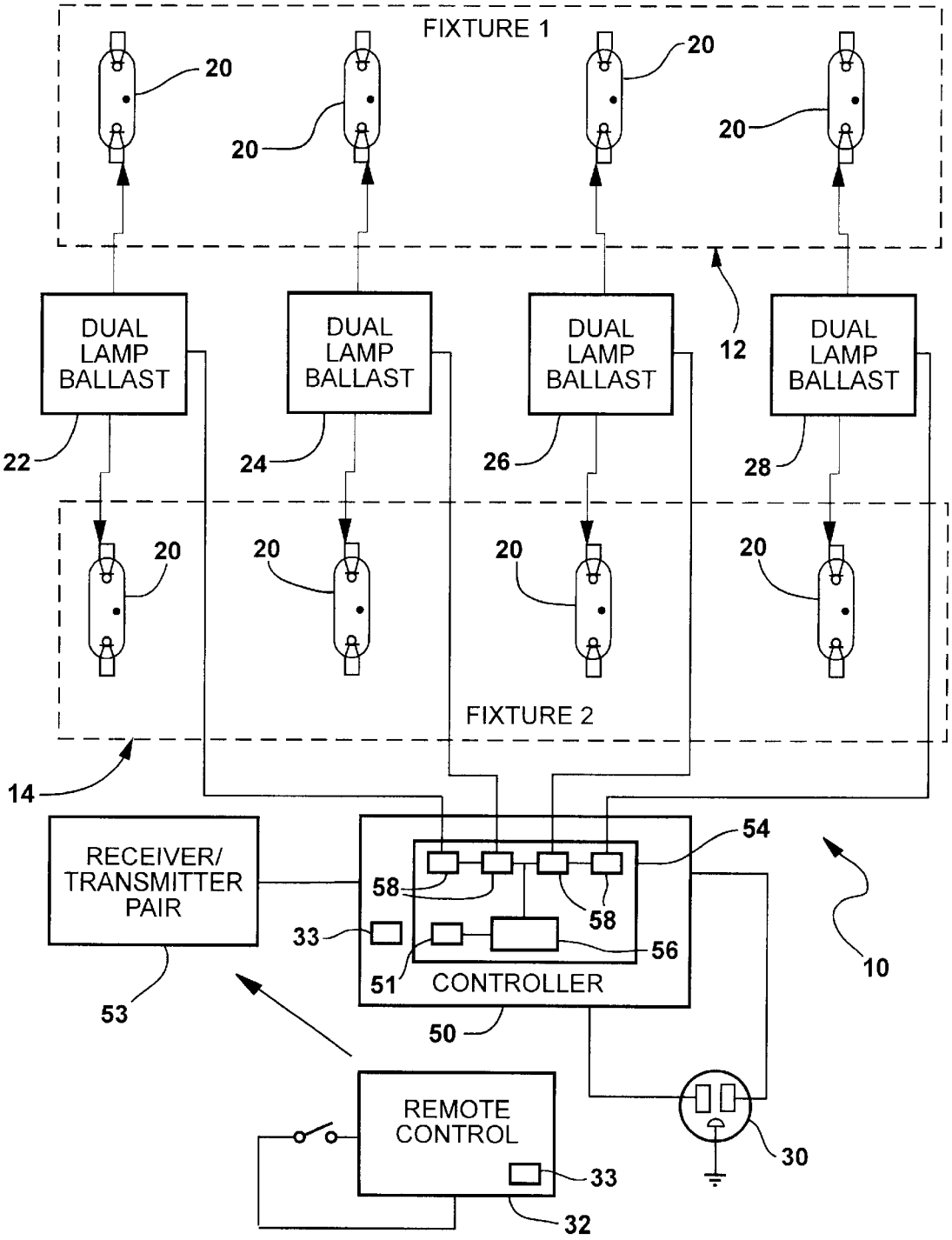
FIG. 3 is a schematic drawing of an alternative embodiment of the subject invention showing the controller having a receiver and transmitter pair.

As shown in FIG. 3, in a large building with a plurality of controllers 50 including one of the controllers 50 for each fixture 12,14, each controller 50 includes a receiver and transmitter pair 53 to receive and re-transmit radio frequency signals to extend the signals through the plurality of fixtures 12,14. This enables a single remote control 32 to signal controllers 50 over the entire building while operating the remote control 32 under non-licensed low power FCC rules. For example, to change the supply of electric power to fixtures outside the range of the remote control 32, the remote control 32 button is first depressed signaling the controllers 50 in close proximity. The receiver 52 receives the RF signal and the transmitter re-transmits the signal to other controllers 50 outside the range of the remote control 32. Each controller 50 will in turn re-transmit the RF signal extending the remote controls 32 RF signal range.

To prevent re-transmitted commands from either interfering with the original signal or from being acted upon twice, the controller 50 includes a delay device between each receiver 52 and transmitter pair to delay the re-transmission of the RF signals from fixture to fixture to allow the re-transmitted RF waves from other controllers 50 to dissipate. The controller 50 also includes code means 33 for producing an encoded message including the time and date enabling a receiving controller 50 to store recent time and date coded signals. The controller 50 is programmed not to act upon RF signals with the same time and date twice. The controller 50 also includes a time limiting device 51 between a receiver and transmitter pair 53 to limit the period of time the controller 50 can receive RF signals. After a controller 50 retransmits a signal, it will wait a short period of time and then prevent the receiver 52 from receiving additional transmission. The lag time is relative to the distance retransmissions will need to travel.

Figure 2:
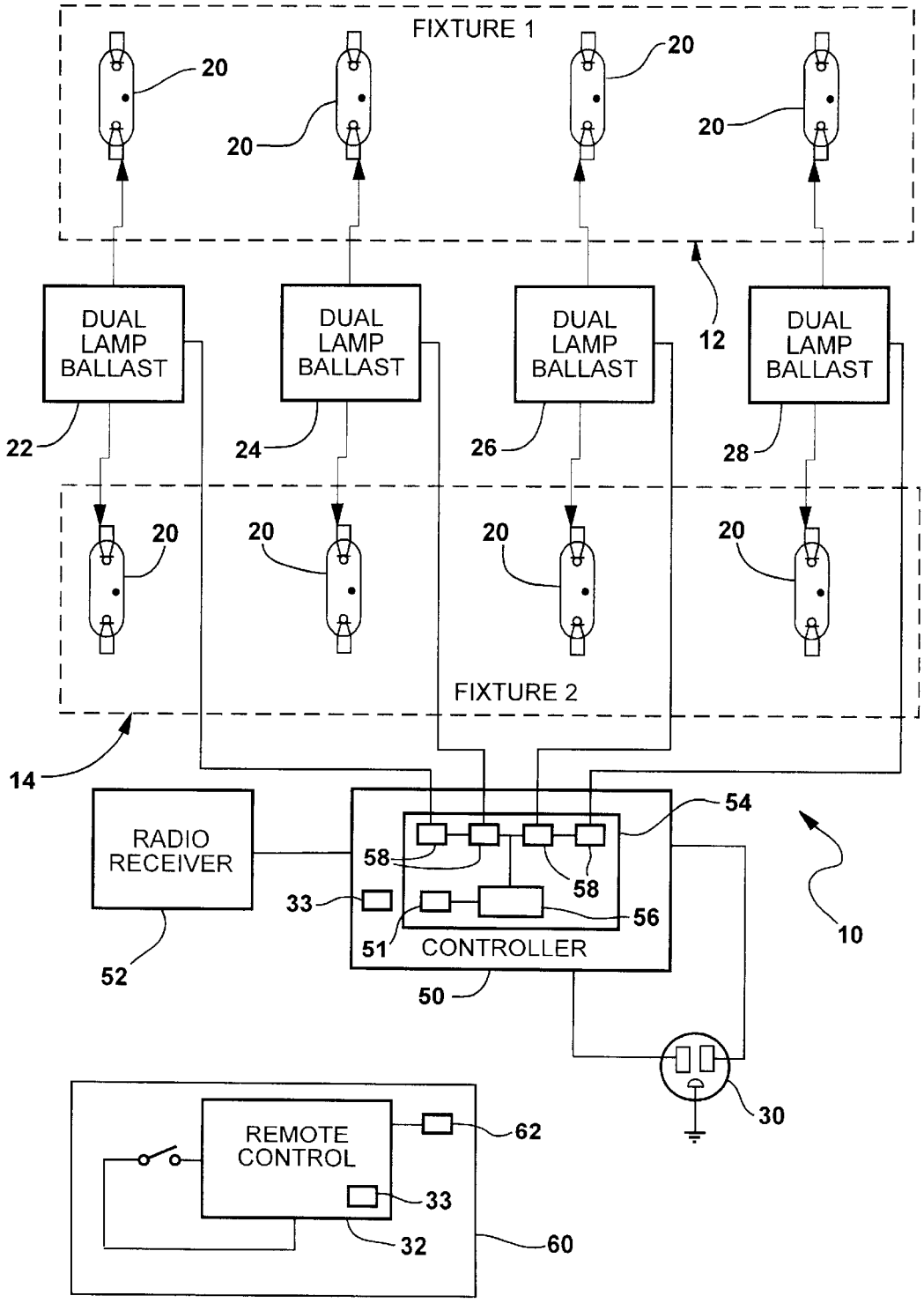
FIG. 2 is a schematic drawing of an alternative embodiment of the subject invention showing the remote control being integral with a lighting panel.

An additional embodiment is shown in FIG. 2 having the remote control 32 mounted in in a lighting panel 60 and includes a clock 62 programmable to terminate and initiate electric power from the main power switch 30 at predetermined times of the day. Programming is accomplished by way of an RF programming transmitter. The RF programming transmitter signals the remote control 32, which is mounted to a lighting panel 60, the time electric power from the main power switch 30 should be initiated or terminated. The RF programming transmitter can also be coded to upload programming to specific remote controls 32 in the event more than one remote control 32 is mounted in a lighting panel 60. Different remote controls 32 can terminate or initiate power to different controllers 50 at different times.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An illumination level control assembly (10) for controlling the level of illumination in a light fixture having a plurality of bulbs (20) connected to an electric power line, said assembly (10) comprising;

a remote control (32) with a single button for producing a single signal, and characterized by a controller (50) responsive to said remote control (32) for sequentially and in numeric order changing the supply of electrical power to the bulbs (20) whereby successive actuations of said single button changes by one the number of bulbs (20) illuminated.

2. An assembly as set forth in claim 1 wherein said remote control (32) produces a radio frequency single signal, and said controller (50) includes a radio frequency receiver (52) to receive a single radio frequency signal from said remote control (32).

3. An assembly as set forth in claim 1 wherein said controller (50) includes a sequencer (54) for sequentially terminating electrical power to the bulbs (20) to successively terminate electric power to the bulbs (20) one at a time.

4. An assembly as set forth in claim 3 wherein said sequencer (54) includes a counter (56) for sequencing through predetermined steps, and a series of switches (58) each responsive to one of said steps for terminating electrical power to one of the bulbs (20).

5. An assembly (10) as set forth in claim 1 wherein said remote control (32) includes code means (33) for producing an encoded message in said single signal.

6. An illumination level control assembly (10) comprising:

a plurality of light bulbs (20), a main power switch (30) for supplying main electrical power to said bulbs (20), a remote control (32) with a single button for producing a single signal, and characterized by a controller (50) responsive to said remote control (32) for sequentially and in numeric order changing the supply of individual electrical power to the individual bulbs (20) whereby successive actuations of said single button changes by one the number of bulbs (20) illuminated.

7. An assembly as set forth in claim 6 including a plurality of fixtures each including a plurality of said bulbs (20), a plurality of ballasts (22,24,26,28) with each ballast (22,24, 26,28) interconnecting two bulbs (20), ballasts (22,24,26,28) from different fixtures being electrically connected to be controlled by said controller (50) in unison.

8. An assembly as set forth in claim 6 wherein said remote control (32) produces a single radio frequency signal, said controller (50) includes a radio frequency receiver (52) to receive a single radio frequency signal from said remote control (4).

9. An assembly as set forth in claim 6 wherein said controller (50) includes a sequencer (54) for sequentially terminating electrical power to the bulbs (20) to successively terminate electric power to the bulbs (20) one at a time.

10. An assembly as set forth in claim 6 wherein said sequencer (54) includes a counter (56) for sequencing through predetermined steps, and a series of switches (58) each responsive to one of said steps for terminating electrical power to one of the bulbs (20).

11. An assembly as set forth in claim 6 wherein said remote control (32) includes code means (33) for producing an encoded message in said single signal.

12. An assembly as set forth in claim 6 including a controller (50) for each fixture, each of said controllers (50) including a receiver and transmitter pair (53) to receive and retransmit radio frequency signals to extend said signals through said plurality of fixtures.

13. A controller (50) as set forth in claim 12 wherein said controller (50) includes a delay device between each receiver (52) and transmitter pair to delay the retransmission of radio frequency signals from fixture to fixture.

14. A controller (50) as set forth in claim 12 wherein said controller (50) includes code means (33) for producing an encoded message including the time and date.

15. A controller (50) as set forth in claim 12 wherein said controller (50) includes a time limiting device (51) between each receiver and transmitter pair (53) for limiting the period of time to receive radio frequency signals.

16. A remote control (32) as set forth in claim 7 wherein said remote control (32) is mounted in a lighting panel (60) and includes a clock (62) programmable to terminate and initiate said electric power from said main power switch (30) at predetermined times of the day.

* * * * *